US006742371B2

(12) United States Patent
Chancerelle

(10) Patent No.: US 6,742,371 B2
(45) Date of Patent: Jun. 1, 2004

(54) FORMING-MACHINE FOR SHEET METAL PARTS BY STRETCHING USING A TOOL OR FORM

(75) Inventor: Gilles Chancerelle, Nantes (FR)

(73) Assignee: ACB Pressure Systems, Nantes (FR)

( * ) Notice: Subject to any disclaimer, the term of this patent is extended or adjusted under 35 U.S.C. 154(b) by 0 days.

(21) Appl. No.: 10/091,349

(22) Filed: Mar. 6, 2002

(65) Prior Publication Data

US 2002/0124618 A1 Sep. 12, 2002

(30) Foreign Application Priority Data

Mar. 9, 2001 (FR) ..... 01 03239

(51) Int. Cl.[7] ..... B21D 11/02
(52) U.S. Cl. ..... 72/296
(58) Field of Search ..... 72/296, 297, 302, 72/295

(56) References Cited

U.S. PATENT DOCUMENTS 2,632,493 A * 3/1953 Gray ..... 72/297
2,676,638 A * 4/1954 Wheeler ..... 72/296
3,459,025 A * 8/1969 Bath ..... 72/296
3,990,288 A * 11/1976 Mackenzie ..... 72/296
5,086,636 A * 2/1992 Huet ..... 72/296

FOREIGN PATENT DOCUMENTS

SU 554908 * 4/1977 ..... 72/296

* cited by examiner

*Primary Examiner*—Daniel C. Crane
(74) *Attorney, Agent, or Firm*—Arent Fox PLLC

(57) ABSTRACT

A forming machine including a frame extending longitudinally on either side of a tool. This tool is arranged transversally to the central portion of the frame. Jaws arranged on either side of the tool, are each actuated by two pairs of quasi-horizontal jacks and quasi-vertical jacks. Each jaw comprises a point which is mobile in a vertical longitudinal plane, and this point is held in such plane by means of one of the control jacks of the jaw especially a quasi-vertical jack. This guiding jack includes pads arranged on the upper end of its roll and these pads slide on longitudinal vertical planes integral with the frame. The cradle of the jaw is hinged on the end of the rod of the guiding jack by means of an axis which is perpendicular to the axis of the jack whereof the axis is situated in the guiding plane.

9 Claims, 2 Drawing Sheets

FORMING-MACHINE FOR SHEET METAL PARTS BY STRETCHING USING A TOOL OR FORM

This invention relates to a forming machine for parts using the stretching method, with a tool or form.

These machines are used notably in the field of aeronautics for the manufacture of fuselage parts for example or parts for the leading edges of the wings.

Such a machine is described in the document FR-2 650 205. This machine, or press, consists of an elongated frame which comprises at its central portion, a table accommodating the tool or form.

The part to be formed may be for example a sheet metal; this sheet metal is held between the claws of two jaws in order to be stretched, beyond its elastic limit, and to be embossed on the form.

These jaws are arranged transversally with respect to the frame, on either side of the tool and each of them is mobile longitudinally and vertically, by means of several pairs of oscillating jacks: quasi-horizontal jacks and quasi-vertical jacks.

The horizontal jacks are mobile in an angular section, on either side of the longitudinal horizontal plane under the effect of the vertical jacks, and the vertical jacks are, similarly, mobile in an angular sector on either side of a plane perpendicular to the longitudinal horizontal plane under the effect of the horizontal jacks. This capacity of movement of the jacks provides, for each jaw, a capacity of displacement practically in all directions.

In the document mentioned above, each jaw is guided with respect to the frame using oscillating props, laid out in the longitudinal and vertical median plane of the frame. Each prop is telescopic. It is hinged at one end of the frame and, on the side of the jaws, it is mobile in a U-shaped guide. The telescopic portion of the prop is integral with the jaw in order to maintain a point of the said jaw in the median vertical longitudinal guiding plane.

This invention provides an alternate solution to the guiding problem of the jaws with respect to the frame.

This solution enables to reduce the number of parts in motion on that machine and the jaws keep high freedom of movement, in particular, in the casing paths of the tool or form.

According to the invention, the machine or press consists of a horizontal frame provided at its central part with a tool or form, mounted transversally with, on either side of said tool, jaws each actuated by two pairs of oscillating jacks: a pair of horizontal jacks, anchored to the corresponding end of the said frame and a pair of vertical jacks anchored to the lower end of the central portion of the bracket-shaped frame, whereas each jaw and its cradle are guided with respect to said frame so that one of their points is held in a longitudinal and vertical plane of said frame, the retaining means of the said point of each jaw and cradle, in said vertical longitudinal plane, consist of guiding means provided on the one hand, directly on the roll of one of the control jacks and, on the other hand, on the frame, in order to maintain the axis of said roll in said vertical longitudinal plane.

The guiding jack is provided in the frame while remaining centered in the vertical longitudinal plane and its roll forms a kind of oscillating rail, by means, on the one hand, of its bottom which is hinged on a bracket below the central section of the frame, along an axis perpendicular to the vertical longitudinal plane and with translation immobilization and, on the other hand, by means of its mouth which is provided with diametrically opposed pads which co-operate with sliding surfaces arranged on the frame, which surfaces are in the form of plates arranged parallel to said vertical longitudinal plane.

The guiding jacks of the jaws consist of the vertical jacks situated for example on the same side of the frame, in the same vertical longitudinal guiding plane.

Each jaw is moreover hinged by its cradle, on the end of the rod of its guiding jack, by means of a spindle whose axis is perpendicular to said jack rod and centered on the guiding plane, i.e. the vertical longitudinal plane of the frame. Besides, the axis of the vertical guiding jack, for each jaw, is arranged so that it runs in the vicinity of the claws of said jaw.

The other control jacks of the jaws, i.e. the jacks other than the vertical jacks guiding said latter are linked to the frame and their respective jaws, by means of spherical plain bearings and/or cardan-type universal joints.

Still according to the invention, the frame comprises mainly a longitudinal structure comprising two large lateral caisson-shaped beams, linked together, and a bracket extending below the central portion of said structure, which bracket is provided with a sole enabling its anchoring on the slab, at the bottom of a pit, for example.

The structure in the form of beams and the bracket make up preferably, especially in the case of a very large press, two separate assemblies; this modular design enables to facilitate the transportation of said press, and said assemblies can be bolted together, for example, on site. Moreover, the upper section of the longitudinal structure forming the frame can be situated at ground level, for instance: in such case, the upper surface of the frame is provided at passage level of the rods of the vertical jacks, with mobile floorings which follow the movement of said rods, providing a certain safety to the operators liable to walk on said frame.

The invention will be detailed further using the following description and the appended drawings, given for exemplification purposes and in which.

Figures 1, 3:
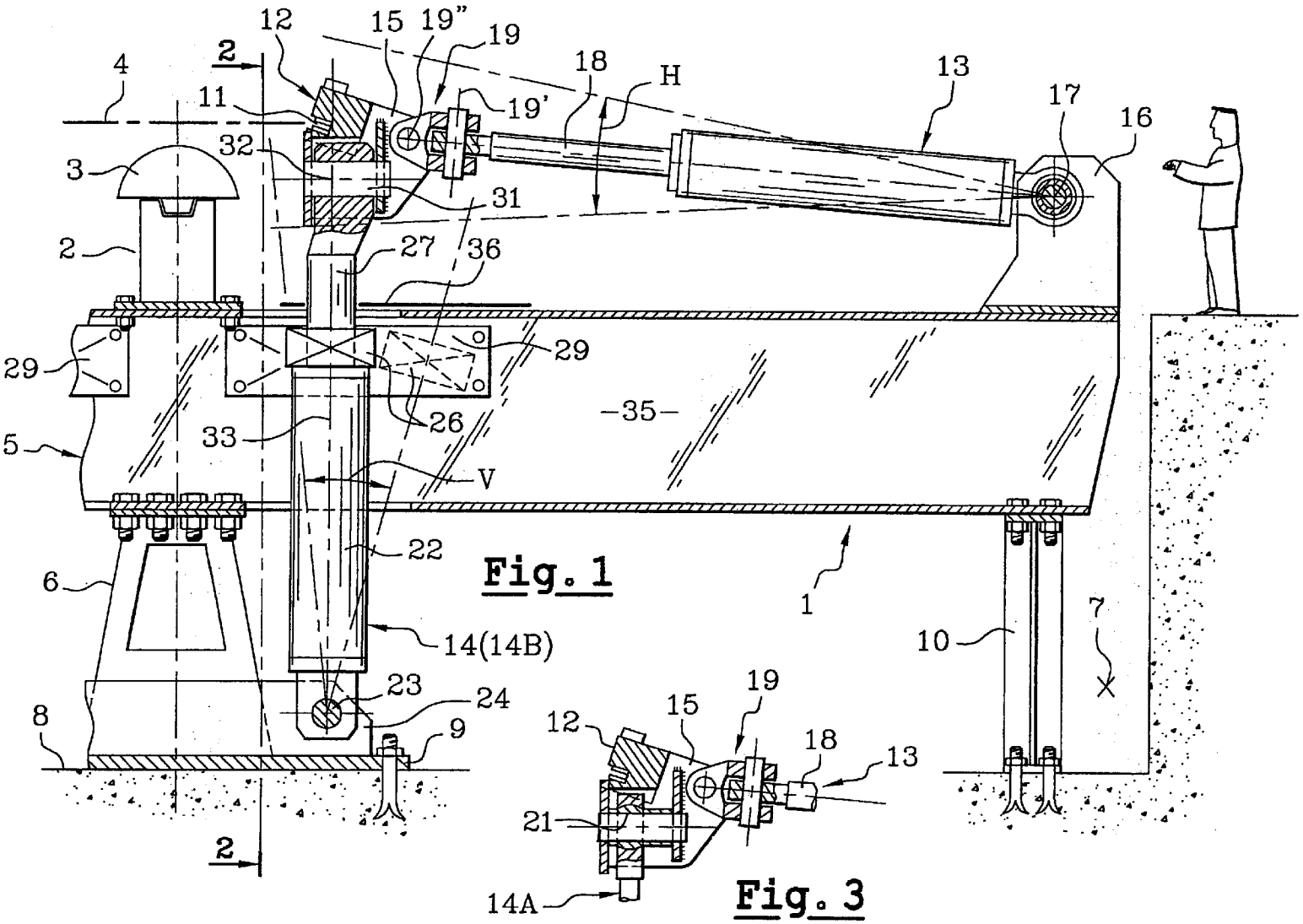
FIG. 1 is an elevation view of a machine according to the invention showing schematically one half of the machine along a cross-section 1—1 of FIG. 2.
FIG. 3 is a partial schematic view of a vertical jack along a cross-section 3—3 of FIG. 2.
Figure 2:
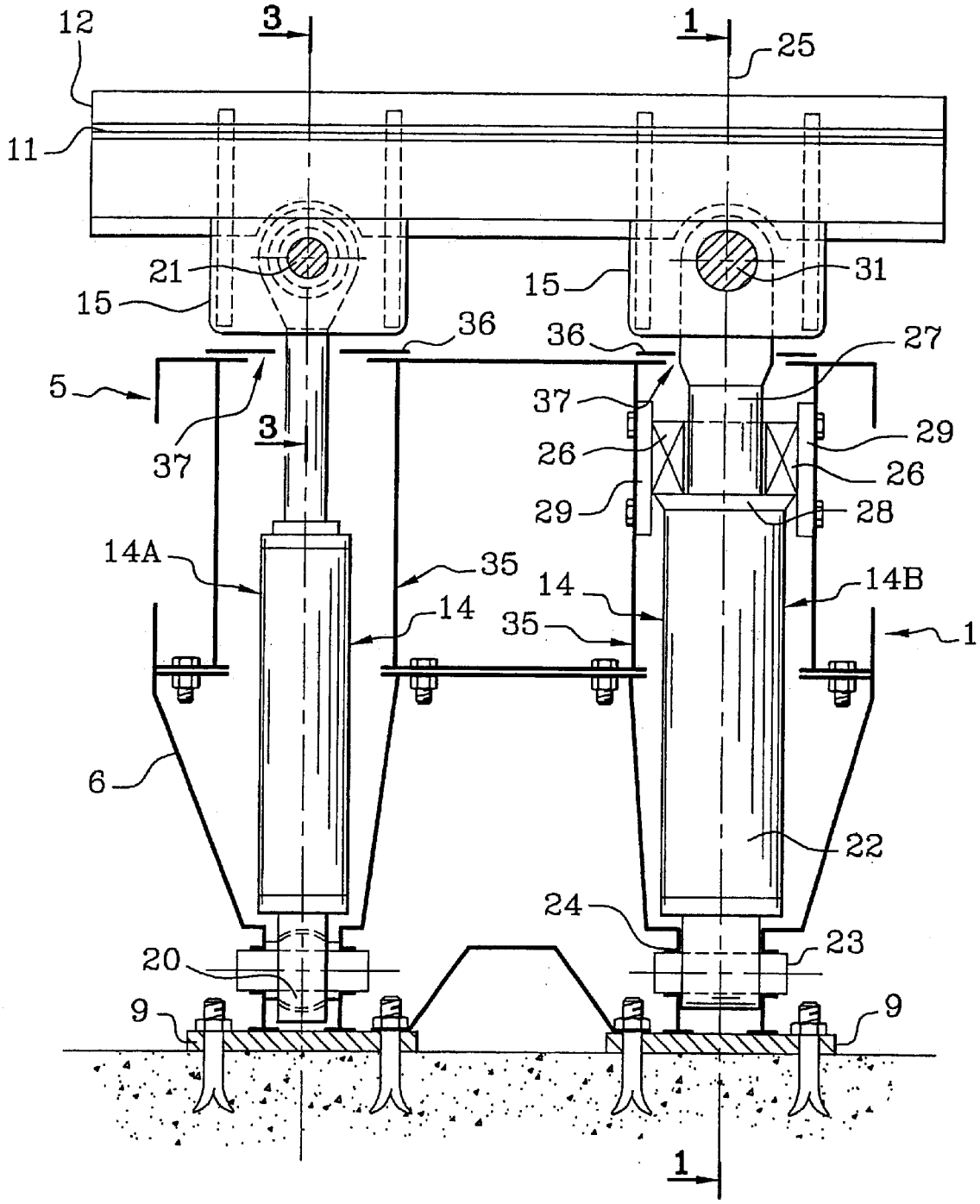
FIG. 2 is an elevation view of the machine along a cross-section 2—2 of FIG. 1.

The machine represented on the figures corresponds in its principle, to that described in document FR-2 650 205 mentioned above.

This machine comprises a frame 1 extending longitudinally and its central portion is provided with a table 2 on which is fixed a tool or form 3 intended for profiling a sheet metal 4 represented as a thin dotted line. The frame 1 comprises a horizontal longitudinal structure 5 on which is fixed the table 2 and a seat or bracket 6 arranged below said structure 5, at right angle to the table 2.

It can be seen on FIG. 1 that the machine can be accommodated in a pit 7, fixed to the slab 8, at the bottom of that pit. The bracket 6 comprises to that effect a seat 9 which is fixed to the slab 8 by appropriate means.

The lateral ends of the structure 5 are for example held by means of props 10 extending down to the bottom of the pit 7.

The sheet metal 4 is pinched on its lateral rims in claws 11 and it is profiled on the tool or form 3 by means of a pair of jaws 12 which carry said claws. These jaws 12 are laid out transversally on either side of the tool 3 and they are controlled by means of oscillating jacks arranged by pairs: jacks 13 designated as horizontal jacks and jacks 14 designated as vertical jacks.

These jacks are in fact anchored to the cradles 15 which serve as supporting structures for the jaws 12.

A pair of horizontal jacks 13 extends between each cradle 15 and bearings 16 situated at the ends of the longitudinal structure 5 of the frame 1.

Each jack 13 is hinged at a bearing 16 by means of a spherical link 17. The rod 18 of the jack 13 is hinged on the cradle 15 by means of a universal joint 19 with two axes 19' and 19" which are perpendicular to one another and perpendicular to the axis of said rod 18.

Each jack 13 has an angular clearance whose amplitude H depends on the stroke of the vertical jack 14 with which it is connected.

Similarly, the vertical jacks 14 (14A and 14B) oscillate under the effect of the horizontal jacks 13 with an amplitude V which depends on the stroke of each of its jacks 13.

Each pair of vertical jacks 14 comprises jacks that are of two types:—a vertical jack 14A which links the cradle 15 and the bracket 6 and—a vertical jack 14B which, moreover, link the cradle 15 to the bracket 6, performs a guiding function of said cradle and consequently the jaw 12, with respect to the frame 1.

The linking jacks 14A are hinged on the lower section of the bracket 6, by means of a spherical plain bearing 20 which is mounted in a bearing integral with the base 9.

The rod of these jacks 14A is hinged on the cradle 15 by means of a spherical plain bearing 21 whose axis is, on the one hand, perpendicular to the axis of said jack 14A and, on the other hand, situated on the longitudinal vertical plane of the frame 1.

FIG. 3 shows the spherical plain bearing 21 mounted on the cradle 15, situated at the end of the rod of the jack 14A.

Still on FIG. 3, the end of the corresponding horizontal jack 13 can be seen, and especially the universal joint 19 linking the rod 18 of that jack to the cradle 15 of the jaw 12.

The jacks 14B perform a double function since they are used on the one hand for controlling the jaws 12 and on the other hand for guiding these jaws with respect to the frame 1.

The roll 22 of the jack 14B is hinged at its bottom, on the lower end of the bracket 6, around an axis 23 which is transversal. This axis 23 is held in the bearing 24 of the base 9, at the lower section of the bracket 6, which bearing performs relative transversal immobilization of the roll 22. The jack 14B being hinged on the axle 23 may oscillate on the vertical longitudinal plane 25.

The upper end or mouth of the roll 22 is provided with pads 26; these pads are provided on either side of the rod 27 of the jack, diametrically opposite. They are fixed to the mouth of the jack, on its collar 28 for example, and they may also be fixed together, transversally.

Each of these pads 26 co-operates together with sliding surfaces arranged in the frame 1. These sliding surfaces consist of plates 29 that are fixed suitably on the structure 5 of the frame 1. The assembly made of the pads 26 and the surfaces 29 forms a rail for each jack 14B. The plates 29 have dimensions suited to the oscillation capacity of the jacks 14B. The pads 26 are rectangular with a length corresponding substantially to the diameter of the roll 32 of the jack and a height of the order of half that of said length. That rail enables to hold the jack 14B in the longitudinal vertical plane 25 of the frame 1.

The rod 27 of the jack 14B is integral with the cradle 15 by means of a spindle 31 which is perpendicular to the axis of said jack and which is situated in the longitudinal vertical plane 25.

Because of its double function, the jack 14B is sized consequently.

Each jaw 12 is provided around an oscillation point 32 which corresponds to the intersection between the axis of the spindle 31 and the axis 33 of the jacks 14B.

This point 32 appears on FIG. 1. This point 32 is provided in the vertical longitudinal plane 25.

It can also be seen that the axis 33 of the jack 14B goes to the level of the claws 11, i.e. at the pinching zone of the sheet metal 4 to be profiled.

The structure 5 of the frame 1 lends itself to this guiding of the vertical jacks. It consists of two beams 35 in the form of caissons, parallel to one another, extending over the whole length of the frame 1. Each beam is situated in the vertical plane of a set of jacks connected to a jaw; whereas this set consists of a horizontal jack 13 and of a vertical jack 14. Each longitudinal vertical plane runs substantially halfway the semi-length of each jaw 12, in order to balance the loads.

According to the dimension of the machine, which can be relatively important, it can be contemplated to realize the frame 1 with two elements: on the one hand, the structure 5 with both its longitudinal beams 35 and, on the other side, the bracket 6. Both these elements can be gathered on site, for example bolted to one another. The greater length of the press also involves the presence of the props 10 situated at each end of the structure 5.

As represented on FIG. 1, the upper section of the structure 5 of the frame 1 can be situated at ground level. To facilitate the intervention of operators on the machine and to prevent accidents, floorings 36 can be provided above the orifices 37 which allow passage through the rods of the vertical jacks 14A and 14B, which floorings can be moved directly under the effect of the rods of said jacks. These floorings 36 mask the oblong orifices 37 and provide a certain safety for the operators walking on the frame 1.

What is claimed is:

1. A forming-machine for sheet metal parts, by stretching on a tool or form, which tool is arranged transversally to a central portion of a frame extending longitudinally, wherein jaws are arranged on either side of the tool, each provided on a cradle that is actuated by two pairs of oscillating control jacks, wherein a pair of quasi-horizontal jacks is anchored to the corresponding end of said frame and a pair of quasi-vertical jacks is anchored to the lower end of the central portion of the frame extending in the form of a bracket, wherein the jaws and their respective cradles are guided with respect to said frame so that one of their points is retained in a vertical longitudinal plane, wherein a retaining means of a point of each jaw and cradle in the vertical longitudinal plane comprises guiding means provided directly on a roll of one of the control jacks of each jaw designed as a control and guiding jack and, on the frame, in order to permanently keep the axis of said control and guiding jack in said vertical longitudinal plane.

2. A forming-machine according to claim 1, wherein the roll of the control and guiding jack forms an oscillating rail, whereas the bottom of said roll is hinged on a spindle integral with the bracket along an axis perpendicular to the vertical longitudinal plane, with a relative translation immobilization and the mouth of said roll is provided with pads diametrically opposed to one another, which co-operate with sliding surfaces in the form of plates, integral with the structure of the frame, which plates are parallel to said plane.

3. A forming-machine according to claim 2, wherein the control and guiding jack which guides the jaws is situated in the vertical longitudinal plane of the frame and comprises one of the quasi-vertical jacks.

4. A forming-machine according to any of claims 1 to 3, wherein each jaw is hinged by its respective cradle on the end of a rod of the control and guiding jack, by a spindle whose axis is perpendicular to said rod and which is centered in the vertical longitudinal plane of the frame.

5. A forming-machine according to claim 4, wherein the axis of the control and guiding jack, for each jaw, is arranged so that it runs in the vicinity of claws of said jaw.

6. A forming-machine according to claim 3, characterized in that the pair of quasi-horizontal jacks and the pair of quasi-vertical jacks for guiding the jaws are linked to the frame and their respective jaws, by spherical plain bearings and/or cardan-type universal joints.

7. A forming-machine according to any one of claims 1 to 3, wherein the frame comprises a longitudinal structure comprising two large beams, linked together, and of a bracket extending below a central portion of said longitudinal structure, which bracket is provided with a base enabling its anchoring on the ground, and on the slab arranged at the bottom of a pit.

8. A forming-machine according to claim 7, wherein the longitudinal structure and the bracket form, two separate assemblies, which are optionally bolted together, and props are provided to hold each end of said longitudinal structure.

9. A forming-machine according to claim 7, wherein an upper section of the beams of the longitudinal structure forms a floor which is optionally situated at ground level, and oblong orifices through rods of the quasi-vertical jacks are provided with mobile floorings which follow a movement of said rods, masking the oblong orifices.

* * * * *